United States Patent [19]

Fell

[11] Patent Number: 5,054,989

[45] Date of Patent: Oct. 8, 1991

[54] SKID-STEER LOADER MINI-CRANE ATTACHMENT

[76] Inventor: Donald M. Fell, RD #3, Box 23 E, Howard, Pa. 16841

[21] Appl. No.: 397,849

[22] Filed: Aug. 24, 1989

[51] Int. Cl.[5] ..... B66F 9/06

[52] U.S. Cl. ..... 414/607; 414/920; 414/680

[58] Field of Search ..... 414/540, 543, 607, 920, 414/680, 685, 718, 722, 724, 728, 912; 212/180, 266, 267

[56] References Cited

U.S. PATENT DOCUMENTS

| | | | |
|---|---|---|---|
| 2,364,493 | 12/1944 | Ulinski | 414/607 |
| 2,433,584 | 12/1947 | Turner | 414/607 |
| 2,445,614 | 7/1948 | Flynn et al. | 414/607 |
| 2,494,651 | 1/1950 | Flynn | 414/607 |
| 2,760,661 | 8/1956 | Wight et al. | 414/607 |
| 2,820,561 | 1/1958 | Meagher | 414/607 |
| 2,831,592 | 4/1958 | Syracuse | 414/607 |
| 2,840,255 | 6/1958 | Pollard | 414/607 |
| 3,007,592 | 11/1961 | Adams | 414/607 |
| 3,207,347 | 9/1965 | Ehrlich | 414/607 |
| 3,294,262 | 12/1966 | Person | 414/607 X |
| 3,396,862 | 8/1968 | Fischer | 414/607 |
| 3,498,485 | 3/1970 | Godbersen | 414/607 X |
| 3,587,893 | 6/1971 | Laken | 414/607 |
| 3,759,399 | 9/1973 | Glass et al. | 414/607 X |
| 3,773,200 | 11/1973 | Morris | 414/607 |
| 3,788,492 | 1/1974 | Kraft | 414/607 X |
| 3,851,777 | 12/1974 | Dilny | 414/607 |
| 4,200,423 | 4/1980 | Sornsin | 414/912 X |
| 4,388,037 | 6/1983 | Suarez | 414/607 |
| 4,579,504 | 4/1986 | Lemme et al. | 414/607 |

FOREIGN PATENT DOCUMENTS

| | | | |
|---|---|---|---|
| 214844 | 4/1961 | Fed. Rep. of Germany . | |
| 89134 | 4/1957 | Norway . | |
| 657326 | 9/1951 | United Kingdom | 414/543 |
| 865160 | 4/1961 | United Kingdom | 414/607 |
| 1332802 | 10/1973 | United Kingdom . | |

OTHER PUBLICATIONS

Brochure, Melroe Company, Bobcat-Vertical Mast Spec.

*Primary Examiner*—David A. Bucci
*Assistant Examiner*—Scott L. Lowe

[57] ABSTRACT

A skid-steer crane attachment is connected to the attachment plate at the front of skid-steer lift arms by a mounting plate and upper and lower mounting brackets. A central boom support is welded to the plate, and a rectangular outer tube is welded to the upper end of the boom support. Angle supports are welded between the outer tube and upper corners of the mounting plate to make the outer tube rigid. A rectangular cross-sectional boom slides within the outer tube and is held in raised, lowered and intermediate positions with a lock pin aligned holes in the boom and outer tube. Booms are extended and lowered with small hand winches and with hydraulics from the supply on the skid-steer. A winch is mounted on the outer tube. A cable extends from a winding reel on the winch, over a sheave and down to a hook which hangs in front of the boom. In one embodiment, the boom support is mounted at an angle to the mounting plate and the outer tube is positioned at the same angle on the upper end of the boom support. In another embodiment, the boom support and mounting plate are vertically mounted on angled lateral supports, and the outer tube is vertically mounted. A forward cantilevered extension at the top of the boom carries a second sheave, over which the cable passes. An L-shaped foot at the bottom of the mounting plate supports swivel casters for supporting the boom on a hard surface when the mounting plate is lowered. A boom cushion on the foot cushions the lower end of the boom.

14 Claims, 3 Drawing Sheets

SKID-STEER LOADER MINI-CRANE ATTACHMENT

BACKGROUND OF THE INVENTION

This invention relates to attachments for skid-steer loaders. Skid-steer loaders are generally known as compact loaders having two fixed axles on which four drive wheels are mounted. For driving forward and rearward, wheels on opposite sides are driven in a uniform sense of rotation. The loaders turn in a tight circle by uniformly driving wheels on opposite sides of the loader in opposite senses of direction. The opposite rotation of the wheels causes the loader to turn while the wheels skid laterally, hence "skid-steer".

Examples of skid-steer loaders are made by three companies, Melroe, Toyota and New Holland. Melroe Company of Fargo, N. Dak., which is business unit of Clark Equipment Company, makes and sells skid-steer loaders under the trademark "Bobcat". Traditionally, the loaders are provided with scoops which are loaded in the lower position by driving the skid-steer into dirt or a pile of material and then raising the scoop on arms. Usually the arms are angular arms which are hinged to supports in upper positions near the rear of the loaders. The arms are raised by hydraulic rams hinged between positions lower on the support and lower on the arms. Other hydraulic rams tilt an attachment plate on which the scoop or bucket is mounted.

Current examples of "typical" skid-steer loaders are:

(1) The Bobcat 643 Series Loader, with SAE-rated operating capacity of 1,000 lbs., load a 86.3 inches (7.2 ft.) and tipping load of 2,200 lbs.

(2) The Toyota 2SDK7 Loader, SAE-rated at 1,150 lbs. operating load and 2,300 lbs. tipping load at 86.2 inches height (7.2 ft.).

The Society of Automotive Engineers (SAE) rates this type of equipment operating capacity with a standard digging bucket according to SAE Standard No. J818B—"Operating capacity to equal no more than one-half the tipping load".

Skid-steer loaders, called Bobcats by the leading U.S. manufacturer of skid-steer loaders, have been available in the United States for nearly three decades. The original market for the skid-steer loaders existed in agriculture, where there was a need for an economical and highly mobile rubber-tired loader. Their uses included transporting and mixing feedstock, cleaning animal stalls, and general handling of bulk materials.

In 1974, the market for skid-steer loaders reached peak sales of approximately 21,000 units. As the American agricultural economy suffered in that year, likewise the market for skid-steers plummeted.

More recently skid-steer loaders have found uses in the construction industry.

As a current example, one large dealer of Toyota skid-steer loaders reported sales and leases of 170 units in 1986. Of that number, only ten percent of the sales were for agricultural use, and 75 percent were sold for use in construction. Total dollar volume in skid-steer loaders by that one dealer in 1986 was approximately 2.7 million dollars.

Many attachments are made to be secured to the attachment plates. As an example, Melroe advertises angle brooms, back hoes, box scrapers, earth augers, pallet forks, utility forks, scarifiers, york rakes, trenchers, farm grapples, blades which may be reset at desired angles and landscape rakes for Bobcat loaders.

Melroe also advertises vertical masts which may be attached to the loaders independently of the lifting arms.

From Toyota and Bobcat, two leading manufacturers of skid-steers, there is currently no attachment for crane-conversion. Those manufacturers were skeptical that such devices would work.

In other fields, there are crane attachments that can be purchased that: 1) bolt to the bed of a truck, or B) devices that slide over the forks of a forklift. However, those latter devices are not related to skid-steer loaders.

None of the attachments currently available from Melroe Bobcat, Toyota or New Holland provide for lifting items high in the air to place or remove items between ceiling beams or the like.

A need exists for a mini-crane attachment which is suitable for use with skid-steer loaders.

SUMMARY OF THE INVENTION

The present invention overcomes problems and deficiencies of the prior art by providing a mini-crane attachment for skid-steer loaders.

A skid-steer crane attachment is connected to the attachment plate at the front of skid-steer loader arms by a mounting plate and upper and lower mounting brackets. A central boom support has a lower end welded to the plate. An outer rectangular tube is welded to the upper end of the boom support. Angle supports are welded between the outer tube and upper corners of the mounting plate to make the outer tube rigid. A rectangular cross-sectional boom slides within the outer tube and is held in raised, lowered or intermediate positions with lock pins in aligned holes. Booms are extended or lowered with a small hand winch or hydraulics from the supply on the skid-steer. A winch is mounted on the outer tube. A cable extends from a winding reel over a sheave and down to a hook which hangs in front of the boom. In one embodiment, the boom support is mounted at an angle to the mounting plate and the outer tube is positioned at the same angle on the upper end of the boom support. In another embodiment, the boom support and mounting plate are vertically mounted on the attachment plate, and the outer tube is vertically mounted. A forward cantilevered extension at the top of the boom carries a second sheave, over which the cable passes.

The present mini-crane attachment is unique to the skid-steer loader industries, greatly increasing the skid-steer capabilities by:

- lifting loads to much greater heights (two times or more);
- lowering loads into trenches or below grade (using winch-out);
- lifting loads at substantial distance from skid-steer. Test results show lifting 1,100 lbs. at 8'6" in front of skid-steer;
- providing variable angles;
- varying height using both boom extension and skid-steer lift arms, together or separately;
- converting the skid-steer into highly mobile mini-crane.

The present invention provides two models of skid-steer-mounted mini-cranes with:

(i) lift of 20 ft. height with 1,000 lbs. load capacity (to fit skid-steers of similar size); and (ii) lift of 24 ft. height with 1,500 lbs. load capacity (to fit larger skid-steers in the 1,500–1,700 lbs. capacity range).

The present invention incorporates two rectangular tubular steel members, sized to permit one to be inserted inside the other of larger interior dimension, in a telescoping fashion, with dimensional tolerance sufficient to allow for longitudinal movement without binding.

The length or height of the boom or telescoping crane can be adjusted by:

1) hydraulic-driven ram using the skid-steer's hydraulic pump capacity; or by 2) mechanical hand winch and lock-pin arrangement to secure boom length.

The telescoping boom is incorporated structurally to the skid-steer arm attachment using heavy-gauge steel members, welded and reinforced. Two different designs are used for mini-cranes:

One design has a straight boom inclined at about 20° to the skid-steer mounting plate.

A second design has a boom with cantilevered top end, attached parallel to the skid-steer mounting plate.

The lifting or winch drive mechanism is powered using either the 12-volt battery/electrical system of the skid-steer, or by hydraulic pump of skid-steer and hydraulic winch motor.

The present invention is an accessory attachment to the skid-steer loader—one that converts the skid-steer into a mini-crane. Uses for this device in the construction industry include the lifting of beams and trusses into place, placing sling supported pallets or smaller loads of building block or bricks onto scaffolding, laying pipe in trenches, lifting sections of pipes and valve assembles into places where access is limited, lifting air conditioning, refrigeration or heating units onto rooftops, and lifting shingles and other roofing materials onto single-story rooftops. The utility afforded a skid-steer loader by the present mini-crane attachment obviates the need for cumbersome and costly mobile overhead cranes that otherwise might be employed for these purposes.

The technology described herein is a novel mechanical device capable of lifting heavy loads (e.g., 1,000 to 1,500 lbs.) safely above the normal lifting height of standard skid-steer loaders. Conventional practice in construction and light industry requires the use of large mobile cranes to raise heavy loads such as roofing materials, trusses, beams, electrical and heating units to a height of 16 to 20 feet above grade, to the roof of a building.

The present invention provides a skid-steer mini-crane attachment having a mounting plate for positioning against a lift frame. Mounting brackets extend rearward from the mounting plate for connecting to a mounting attachment on the lift frame. A boom support has upper and lower ends; a lower end of the boom support is connected to the mounting plate. A boom-holding outer tube is connected to an upper end of the boom support. The outer tube has closed sides and open upper and lower ends. A boom is positioned in the outer tube and slides within the outer tube. Boom positioning means connected to the outer tube and to the boom selectively positions the boom within the outer tube in raised, lowered and intermediate positions. A winch support is connected to the outer tube. A winch is mounted on the winch support. A sheave is connected to an upper end of the boom. A cable wound around the winch and passing over the sheave has a free end spaced horizontally outward from the boom. A hook is connected to the free end of the cable for raising and lowering objects connected to the hook as the cable is wound and unwound with the winch.

The preferred mini-crane apparatus includes angle supports connected between upper outer edges of the mounting plate and the outer tube for supporting the outer tube and the boom.

The preferred positioning means includes first horizontal openings extending through walls of the outer tube and second horizontal openings extending through walls of the boom for alignment with the first horizontal openings, and a lock pin extending through aligned openings in the outer tube and the boom.

A preferred positioning means further includes a small boom-lifting winch mounted on a side of the outer tube near the open lower end. A boom-lifting cable is wrapped around the boom-lifting winch reel and has a free end spaced therefrom for connecting the free end of the boom-lifting cable to a lower end of the boom.

In one preferred embodiment, the boom support extends upward and outward from the mounting plate at an angle from about 10° to about 30° and preferably about 20°. The outer tube is aligned at that angle with the mounting plate. The boom is mounted in the outer tube at that angle with the mounting plate.

The mounting plate of the skidsteer is equipped with hydraulic ram and can be rotated. The specific angle at which the mini-crane attachment is secured to the mounting plate can be varied.

In another preferred embodiment, the boom support comprises a back plate extending generally upward from the mounting plate in a direction substantially parallel to a vertical direction of the mounting plate. The angle supports comprise structural members generally mounted perpendicularly to the mounting plate and extending upward and inward and having opposite upper ends connected to opposite side walls of the outer tube for supporting the outer tube.

In that embodiment, the boom further comprises a cantilevered upper end section connected to an upper end of the boom and a second sheave mounted at an outer end of the cantilevered section. The cable passes over the sheave attached to the top of the boom and the second sheave attached to the outer end of the cantilevered section, and the free end of the cable is spaced outward from the boom. The backing plate further comprises an L-shaped foot extending along the bottom of the plate.

The use of a cantilevered upper end helps to provide extra clearance between the mini-crane boom and object being lifted. the cantilevered embodiment is at this time the preferred model for the skidsteer market. The 10°, 20° or 30° model will work as well.

These and other and further objects and features of the invention are apparent in the disclosure, which includes the above and ongoing specification, with the claims, and the drawings.

DETAILED DESCRIPTION OF THE DRAWINGS

Figure 1:
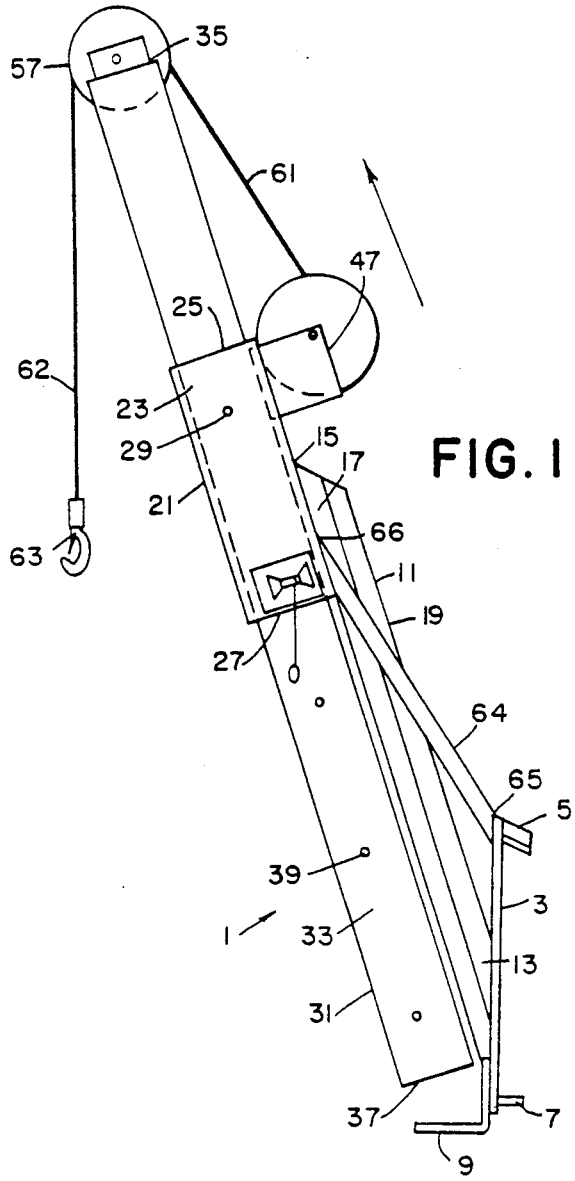
FIG. 1 is a side elevation of the skid-steer loader mini-crane attachment of a preferred embodiment.
Figure 2:
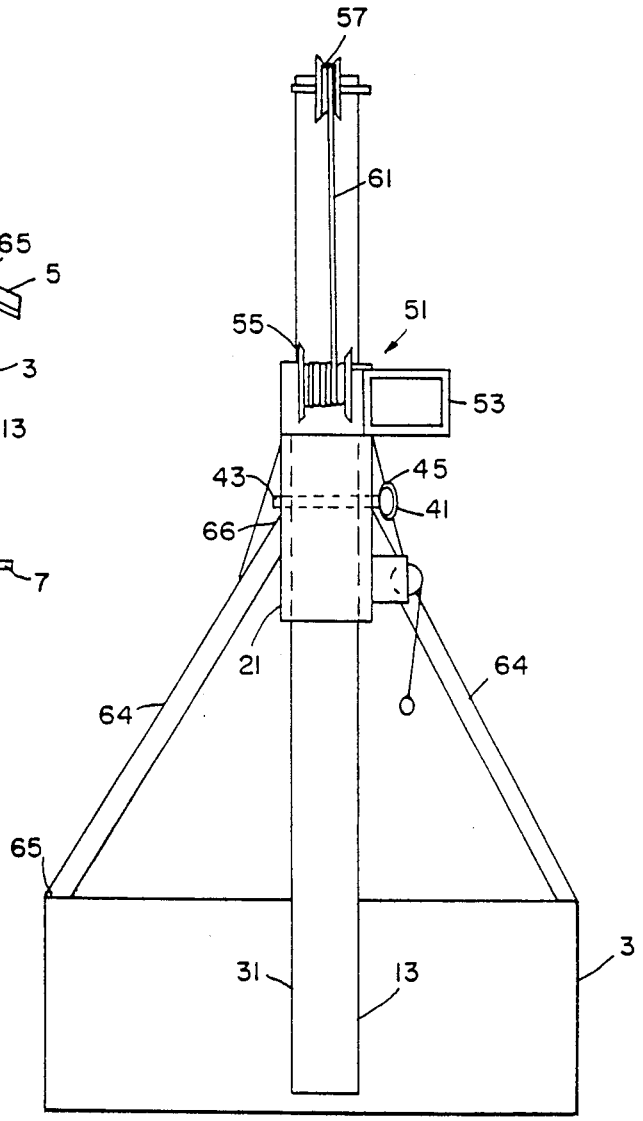
FIG. 2 is a rear elevation of the mini-crane attachment shown in FIG. 1.

Referring to FIGS. 1 and 2, a mini-crane attachment for a skid-steer loader is generally indicated by the numeral 1. A mounting plate 3 has an upper mounting bracket 5 and a lower mounting bracket 7 for connecting to the locking attachment devices on an attachment plate on a skid-steer loader. An L-shaped foot 9 extends across the mounting plate 3. A boom support 11 has a lower end 13 which is welded to the mounting plate 3. An upper end 15 of the boom support 11 is connected to a boom receiving outer tube 21. In the embodiment shown in FIG. 1 and 2, the boom support 11 is a T-shaped beam having a forward facing flat flange 17 and a rearward facing web 19. The outer tube 21 is constructed with a rectangular shape having side walls 23 and upper and lower open ends 25 and 27. A first set of mounting holes 29 extends horizontally through opposite side walls 23 of the outer tube 21. A boom 31, which is preferably a box-shaped structural member, slides through the outer tube 21. Boom 31 can be raised (extended) and lowered by a small crank operated boom lifting winch 128. Winch 128 is mounted on a side wall and at a lower end of outer tube 21, as shown in FIG. 2. Winch 128 has a boom lifting cable, a free end of which can be connected to a lower end of the boom 31. The boom 31 has side walls 33 and upper and lower ends 35 and 37. Holes 39 extend horizontally through opposite side walls 33. A lock-pin 41 has a shaft 43 which extends through aligned openings 29 and 39 in the outer tube and boom to lock the boom in outer tube 21 in extended or lowered position or in a selected position of intermediate extension. A handle 45 on lock-pin 41 is used to withdraw and insert the lock-pin 41.

A box-shaped winch-mounting bracket 47 is mounted on a rear wall of the outer tube 21 near upper end 25. A winch 51 mounted on the bracket 47 has a winding motor 53 which drives a reel 55 through non-free winding reduction gears.

The winch motor 53 must be positively rotated in winding or unwinding directions to turn reel 55. A sheave 57 at the upper end 35 of boom 31 receives a cable 61, which is wound on reel 55. A free end 62 of the cable, which is supported outwardly from the boom by sheave 57, supports a hook 63.

Lateral stability of the outer tube 21 and hence the boom 31 is created by angle supports 64 having lower ends 65 attached to upper corners of the mounting plate 3 and having upper ends 66 attached to the outer tube 21.

Figure 4:
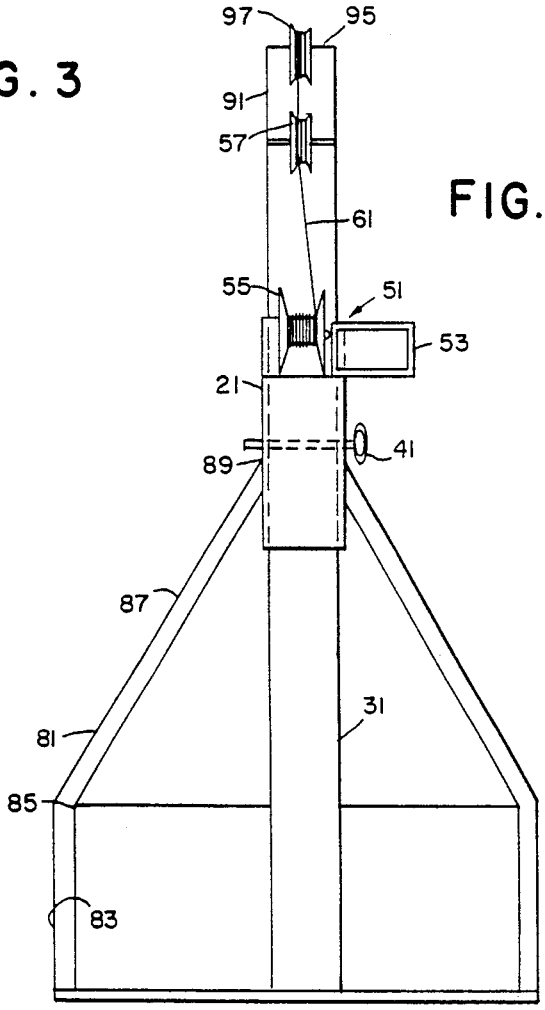
FIG. 4 is a rear elevation of the embodiment shown in FIG. 3.

As shown in FIG. 4, one alternate embodiment 101 of the mini-crane attachment is generally indicated by the numeral 101. Similar elements within the mini-crane are similarly numbered. In mini-crane 101 the outer tube 21 is vertically mounted with respect to mounting plate 3. A back plate 71 extends vertically upward from an upper edge of the mounting plate 3 and is connected to the outer tube 21. The outer support of the tube is provided by the back plate 71 and lateral members 81, which have lower vertical portions 83 attached to lateral edges of the mounting plate 3 and to foot 9. The side support members 81 are welded 85 near an upper extremity of the mounting plate 3, joining inward sloped portions 87 with lower lateral portions 83. Upper ends 89 which are welded to the outer tube. A cantilevered extension 91 is mounted on upper end 35 of the boom 31. A gusset 93 supports the extension 91 on the upper end 35 of the boom. A second sheave 97 is mounted on upper end 95 of the boom extension 91. The cable 61 passes over the first and second sheaves 57 and 97 to support the free end 62 of the cable 61 spaced outward from the boom 31.

While both mini-crane embodiments are similar, the two designs are really two different structural solutions to mini-crane problems.

In the embodiment shown in FIGS. 1 and 2 (inclined to mounting plate), the central boom support 11 carries much of the structural load from outer tube 21.

Figure 3:
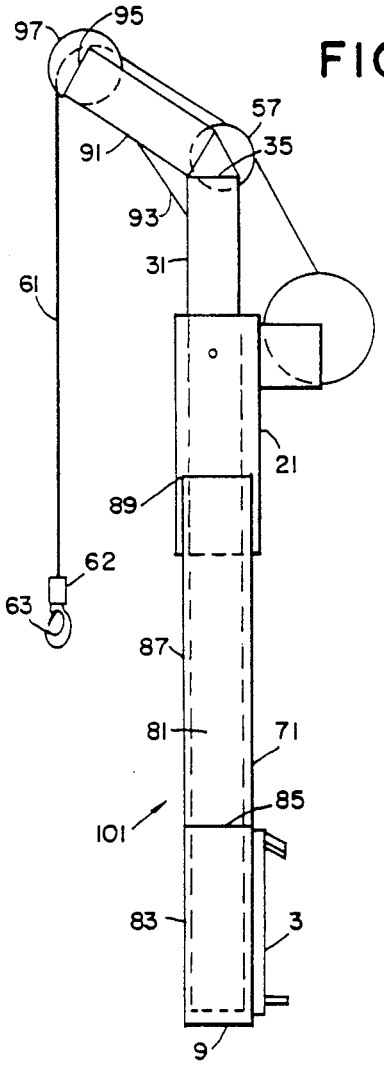
FIG. 3 is a side elevation of a second embodiment of the invention.

In the embodiment shown in FIGS. 3 and 4 (parallel to mounting plate), there is no central boom support. Although back plate 71 carries some structural load from the outer tube, much of the structural load is carried by the two lateral members 81.

The back plate 71 is quite thin and lightweight compared to lateral support members 81, which are, for example, four inch channels weighing about 5.4 lbs per linear foot. It is possible to use heavier gauge plate for 71 to carry more load.

Figure 5:
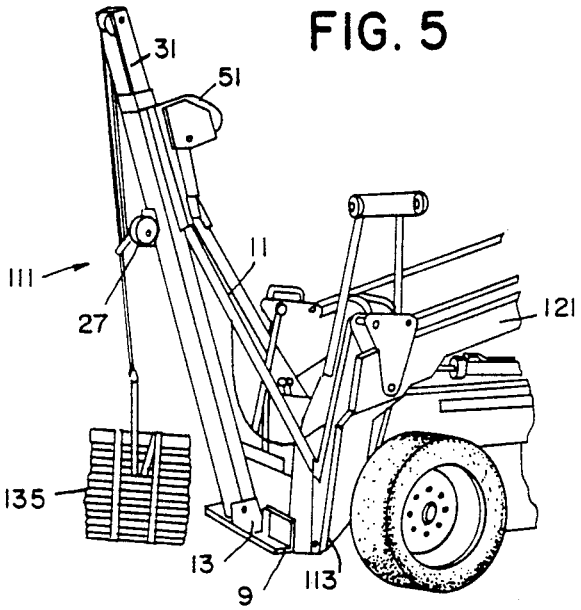
FIG. 5 is a perspective view of the use of a mini-crane attachment shown in FIGS. 1 and 2.
Figure 6:
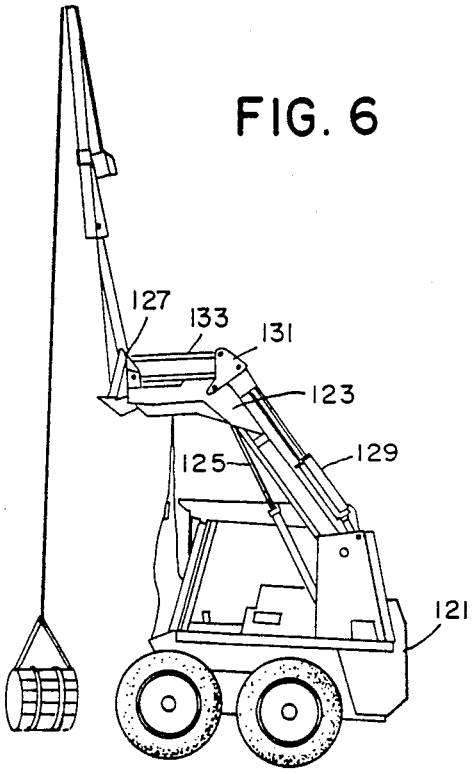
FIG. 6 is a view showing the mini-crane in raised position.

FIGS. 5 and 6 show a mini-crane attachment 111 similar to that shown in FIG. 1. The mini-crane attachment has a foot 9 made of an angle iron welded between spaced mounting plate portions 113 which are provided with rearward extending mounting brackets for connection to the mounting plate on the skid-steer 121 lift arms 123.

As shown in FIG. 6, lifts arms 123 are raised by parallel rams 125. The angle of the attachment plate 127 is controlled by parallel rams 129 which are connected to the attachment plate 127 through cranks 131 and links 133 as is conventional. In other skid-steers, angular relations of the attachment plates 127 to the lift arms 123 are controlled by rams connected directly between the attachment plates and the lift arms.

As shown in FIG. 5, the lower end 13 of the boom support 11 is connected to the vertical plate of the foot 9. Other elements are similar to those shown in FIG. 1. Boom 31 has been lowered by crank operated winch 128. Winch 51 holds the load 135 near the ground at the free end of cable 61 attached to winch 51 at one end and passing over sheave 57 at the upper end 35 of boom 31.

In FIG. 6, boom 31 has been raised to its uppermost position within outer tube 21 and lift arms 123 have raised the mini-crane assembly to its full upward position. Load 135 remains near the floor ready to be winched upward into position near the ceiling of the warehouse.

Whereas the boom can be retracted to the lowered position as shown in FIG. 5, another important feature of the mini-crane attachment is that it can be moved or driven wherever the skidsteer can go—inside buildings, through doorways, etc. Thus the present invention provides a highly maneuverable crane for use inside buildings, plants and factories.

The mini-crane attachment shown in FIGS. 5 and 6 was equipped with a winch with 65 ft. of cable. By positioning the mini-crane/skidsteer over a mine-shaft, service shaft, hole or the like, in the lowered position (FIG. 5) the hook at the free end of the cable may be lowered into shafts or holes approximately 55 ft. below grade, again demonstrating the versatility of the mini-crane of the present invention.

Photographs such as FIGS. 5 and 6 show the present mini-crane with 1,100 lbs. test load hooked to free ends of the cables, at a height of about 1 ft. above the concrete, thus demonstrating significant load lifting capacity.

Tests with a fully extended boom on fully raised arms proved stability with a load of 1,100 lbs. from about 3 feet to about 8½ feet in front of the skid-steer.

Figure 7:
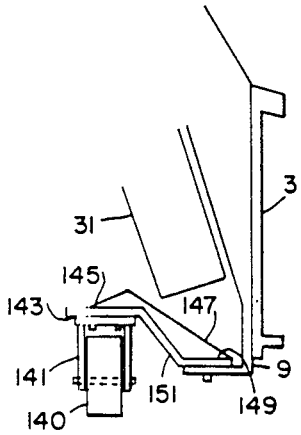
FIGS. 7–11 show swivel caster supports.

FIG. 7 shows a caster wheel 140 mounted in a forked bracket 141 on a swivel plate 143, which is connected to a flat outer surface 145 of a support plate 151 with a gusset 147. The support plate has a flat inner surface 149 bolted to the L-shaped foot 9 at the lower end of mounting bracket 3. Plate 151 has two flat portions 145 and 149 and a central flat portion. The support plate 151 preferably is a short or long support plate, mounted in pairs at opposite extremities of the foot plate 9. Alternately, plate 151 may extend entirely across the horizontal flat plate of foot 9.

The caster wheel 140 supports the boom 31 against tipping when the boom is extended and loaded and when mounting plate 3 is in the lowered position, with caster wheel 140 resting on a hard floor, for example, concrete. In a preferred embodiment the supporting gussets 147 are arranged in a parallel configuration.

Figure 8:
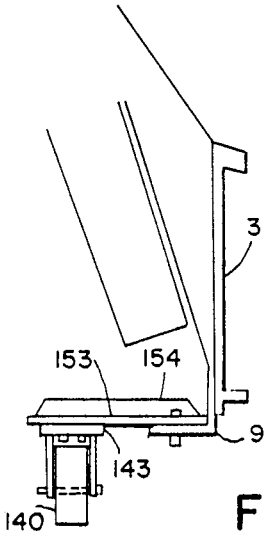

FIG. 8 shows a flat plate 153 connected at one end to the forward extending flange of the foot 9. At the forward end of the mounting plate 153 the swivel 143 is mounted to support the caster wheel 140. One or more gussets 154 may extend across the mounting plate 153 to provide strain resistance when weight is borne by the caster wheels 140. Preferably one mounting plate 153 and caster wheel 140 are mounted at each extemity of the L-shaped foot 9.

Figure 9:
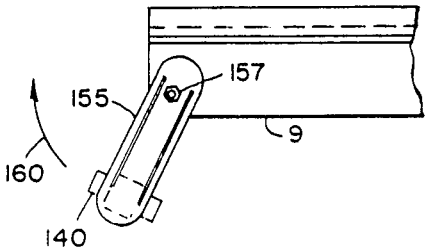

FIG. 9 shows a swivel plate 155 pivoted 157 to the horizontal flange of L-shaped foot 9 to support a caster wheel 140, either in front of or at the side of the mounting plate. The swivel mounting of plate 155 provides either lateral support when the plate 155 is swung in the direction of arrow 160 to the side of mounting plate 9, or to provide additional frontal clearance in that position, or the plate 155 may be swung to the forward position to provide additional stability against tipping.

Figure 10:
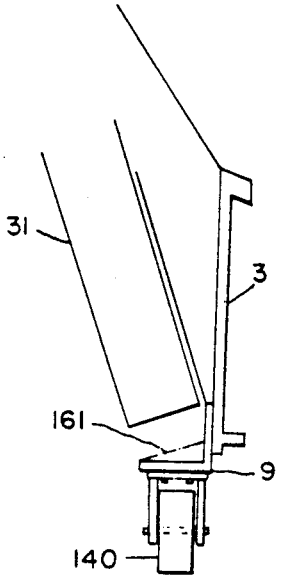

FIG. 10 shows a caster wheel 140 mounted directly beneath the horizontal plate of the foot 9. Triangular gussets may be welded between flanges of the L-shaped foot 9 to provide support against bending stresses. A boom pad 161 is provided to face the bottom of the boom to stop and protect the lower end of the boom while raising or lowering the boom.

Figure 11:
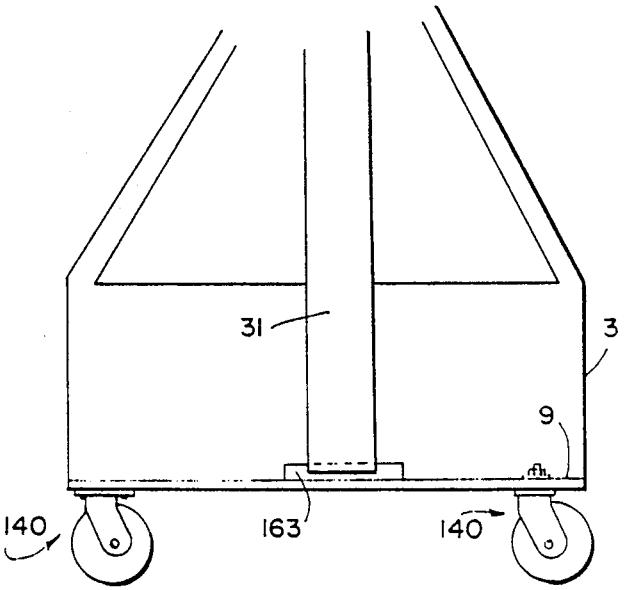

As shown in FIG. 11, caster wheels 140 are mounted on both ends of the horizontal flange of foot 9. The boom pad or boom cushion 163 is flat to support the lower end of vertical boom 31. In preferred embodiments the bump cushions 161 and 163 are made of all metal or metal with a cushioning material to protect the lower end of the boom.

The swivel casters act as stabilizers to increase the stability of the mini-cranes, both front and back and left to right, with the radial mounted stabilizers positioned for greatest width, such as shown in FIG. 9. The casters may be plate mounted and stud and post mounted swivel casters. The casters may be directly mounted to the mounting plate foot or may be mounted on radially mounted stabilizers. The caster wheels may be mounted on offset stabilizers such as shown in FIG. 7, or level mounted stabilizers such as shown in FIGS. 8–11. The offset radial mounted stabilizers shown in FIG. 7 and the level radial mounted stabilizers shown in FIG. 8 may swivel as shown in FIG. 9.

While the inclined boom shown in FIGS. 1 and 2 uses a straight boom, the inclined boom shown in FIGS. 1 and 2 may have an upper angular extension such as shown in FIGS. 3 and 4.

While the invention has been described with reference to specific embodiments, modifications and variations of the invention may be constructed without departing from the scope of the invention, which is described in the following claims.

I claim:

1. A skid-steer mini-crane attachment comprising a generally vertical mounting plate having a vertical face for positioning against a lift frame, mounting brackets extending rearward from and directly connected to the vertical face of the mounting plate for connecting to a mounting attachment on the lift frame, a boom support having upper and lower ends, a lower end of the boom support directly connected to the mounting plate vertical face, a boom-holding outer tube connected to an upper end of the boom support, the outer tube having closed sides and open upper and lower ends, a boom positioned in the outer tube and slidable within the outer tube, boom positioning means connected to the outer tube and to the boom for selectively positioning the boom within the outer tube in raised, lowered and intermediate positions, a winch support connected to the outer tube, a winch mounted on the winch support, a sheave connected to an upper end of the boom, a cable wound around the winch and passing over the sheave and having a free end spaced horizontally outward from the boom, and a hook connected to the free end of the cable for raising and lowering objects connected to the hook as the cable is wound and unwound with the winch.

2. The apparatus of claim 1, further comprising angle supports connected between upper outer edges of the mounting plate and the outer tube for supporting the outer tube and the boom.

3. The apparatus of claim 1, wherein the positioning means comprises first horizontal openings extending through the outer tube and second horizontal openings extending through the boom for alignment with the first horizontal openings, and a lock pin extending through aligned openings in the outer tube and the boom.

4. A skid-steer mini-crane attachment comprising a generally vertical mounting plate having a vertical face for positioning against a lift frame, mounting brackets extending rearward from and directly connected to the vertical face of the mounting plate for connecting to a mounting attachment on the lift frame, a boom support having upper and lower ends, a lower end of the boom support directly connected to the mounting plate vertical face, a boom-holding outer tube connected to an upper end of the boom support, the outer tube having closed sides and open upper and lower ends, a boom positioned in the outer tube and slidable within the outer tube, boom positioning means connected to the outer tube and to the boom for selectively positioning the boom within the outer tube in raised, lowered and intermediate positions, a winch support connected to the outer tube, a winch mounted on the winch support, a sheave connected to an upper end of the boom, a cable wound around the winch and passing over the sheave and having a free end spaced horizontally outward from the boom, and a hook connected to the free end of the cable for raising and lowering objects connected to the hook as the cable is wound and unwound with the winch, wherein the positioning means comprises first horizontal openings extending through the outer tube and second horizontal openings extending through the boom for alignment with the first horizontal openings, and a lock pin extending through aligned openings in the outer tube and the boom, wherein the positioning means further comprises a small boom-lifting winch mounted on a side of the outer tube near the lower end, a boom-lifting cable wrapped around the boom-lifting winch and having a free end spaced therefrom, and means for connecting the free end of the boom moving cable to a lower end of the boom.

5. The apparatus of claim 1, wherein the boom support extends upward and outward from the mounting plate at an angle of about 20°, and wherein the outer tube is aligned at an angle of about 20° with the mounting plate, whereby the boom is mounted at an angle of about 20° with the mounting plate.

6. The apparatus of claim 1, wherein the boom support comprises lateral angle supports extending generally upward and inward in a direction substantially parallel to a vertical direction of the mounting plate having lower ends attached to the upper corners of the mounting plate and upper ends attached to the outer tube.

7. The apparatus of claim 6, wherein the lateral angle supports comprise structural members generally mounted perpendicularly to the mounting plate and extending upward and inward and having opposite upper ends connected to opposite side walls of the outer tube for supporting the outer tube.

8. The apparatus of claim 6, wherein the boom further comprises a cantilevered upper end section connected to an upper end of the boom and a second sheave mounted at an outer end of the cantilevered section, and wherein the cable passes over the sheave attached to the top of the boom and the second sheave attached to the outer end of the cantilevered section whereby the free end of the cable is spaced outward from the boom.

9. The apparatus of claim 1, wherein the mounting plate further comprises an L-shaped foot extending along the bottom of the mounting plate.

10. A skid-steer mini-crane attachment comprising a generally vertical mounting plate for positioning against a lift frame, mounting brackets extending rearward from the mounting plate for connecting to a mounting attachment on the lift frame, a boom support having upper and lower ends, a lower end of the boom support connected to the mounting plate, a boom-holding outer tube connected to an upper end of the boom support, the outer tube having closed sides and open upper and lower ends, a boom positioned in the outer tube and slidable within the outer tube, boom positioning means connected to the outer tube and to the boom for selectively positioning the boom within the outer tube in raised, lowered and intermediate positions, a winch support connected to the outer tube, a winch mounted on the winch support, a sheave connected to an upper end of the boom, a cable wound around the winch and passing over the sheave and having a free end spaced horizontally outward from the boom, and a hook connected to the free end of the cable for raising and lowering objects connected to the hook as the cable is wound and unwound with the winch, wherein the mounting plate further comprises an L-shaped foot extending along the bottom of the mounting plate, further comprising caster wheel assemblies mounted at spaced positions on the L-shaped foot.

11. The apparatus of claim 10, wherein each caster wheel assembly comprises a plate having a first end mounted on a horizontal flange of the L-shaped foot and having a second end positioned remote from the L-shaped foot, and wherein a caster wheel swivel base is mounted on the end of the plate remote from the horizontal flange of the L-shaped foot.

12. The apparatus of claim 11, further comprising perpendicular gussets connected to the plate for strengthening the plate.

13. The apparatus of claim 11, wherein the outer end of the plate is vertically offset from the inner end of the plate, the plate having horizontal outer and inner portions and a sloped intermediate portion.

14. A skid-steer mini-crane attachment comprising a generally vertical mounting plate for positioning against a lift frame, mounting brackets extending rearward from the mounting plate for connecting to a mounting attachment on the lift frame, a boom support having upper and lower ends, a lower end of the boom support connected to the mounting plate, a boom-holding outer tube connected to an upper end of the boom support, the outer tube having closed sides and open upper and lower ends, a boom positioned in the outer tube and slidable within the outer tube, boom positioning means connected to the outer tube and to the boom for selectively positioning the boom within the outer tube in raised, lowered and intermediate positions, a winch support connected to the outer tube, a winch mounted on the winch support, a sheave connected to an upper end of the boom, a cable wound around the winch and passing over the sheave and having a free end spaced horizontally outward from the boom, and a hook connected to the free end of the cable for raising and lowering objects connected to the hook as the cable is wound and unwound within the winch, wherein the mounting plate further comprises an L-shaped foot extending along the bottom of the mounting plate, further comprising a boom cushion mounted on the L-shaped foot beneath the boom for cushioning a lower end of the boom.

* * * * *